US010273684B2

(12) United States Patent
Breaz

(10) Patent No.: US 10,273,684 B2
(45) Date of Patent: Apr. 30, 2019

(54) PRECAST BUILDING BLOCK, MODULAR ELEMENT WITH OPTIMIZED GEOMETRY, PROCESS FOR OBTAINING THE MODULAR ELEMENT, CONSTRUCTION, METHOD FOR OBTAINING A BUILDING BY ASSEMBLING THE MODULAR ELEMENTS

(71) Applicant: Laurentiu Dumitru Breaz, Aiud (RO)

(72) Inventor: Laurentiu Dumitru Breaz, Aiud (RO)

( * ) Notice: Subject to any disclaimer, the term of this patent is extended or adjusted under 35 U.S.C. 154(b) by 0 days.

(21) Appl. No.: 15/573,556

(22) PCT Filed: May 10, 2016

(86) PCT No.: PCT/RO2016/000018

§ 371 (c)(1),
(2) Date: Nov. 13, 2017

(87) PCT Pub. No.: WO2016/182467

PCT Pub. Date: Nov. 17, 2016

(65) Prior Publication Data

US 2018/0119418 A1 May 3, 2018

(30) Foreign Application Priority Data

May 12, 2015 (RO) ..... A2015 00334

(51) Int. Cl.
*E04C 1/00* (2006.01)
*E04B 2/18* (2006.01)
(Continued)

(52) U.S. Cl.
CPC ..... *E04B 2/18* (2013.01); *E04B 2/16* (2013.01); *E04B 2/26* (2013.01); *E04C 1/40* (2013.01);
(Continued)

(58) Field of Classification Search
CPC ..... E04C 2/205; E04C 2/288; E04C 2/049; E04C 1/41; E04C 1/40; E04B 2002/867;
(Continued)

(56) References Cited

U.S. PATENT DOCUMENTS 4,903,446 A * 2/1990 Richards ..... E04B 1/06 52/223.6
5,231,813 A * 8/1993 Drawdy ..... E04C 2/288 52/251
(Continued)

FOREIGN PATENT DOCUMENTS

DE 21 56 006 A1 7/1973
GB 439 349 A 12/1935
(Continued)

OTHER PUBLICATIONS

International Search Report received for PCT Patent Application No. PCT/RO2016/000018 dated Oct. 24, 2016, 3 pages.

*Primary Examiner* — Gisele D Ford
(74) *Attorney, Agent, or Firm* — Amster, Rothstein & Ebenstein LLP

(57) ABSTRACT

The invention refers to precast blocks for constructions from which modular elements of insulating material, with optimized geometry are obtained, to a network of channels obtained by assembling the modular elements, to a supporting structure, to a process of obtaining a construction by assembling the modular elements. The precast block for construction, according to the invention, comprises an exterior face provided with recessed areas and protrusions such that the thickness g of the precast block wall is uniform, and fastening areas for veneering elements, considering of ribs set on the protrusions, and/or a surface without recesses and protrusions, obtaining a higher thickness of the precast block wall, for the precast blocks destined to be positioned in the areas where the outer surface of a construction obtained
(Continued)

from precast blocks is larger than its inner surface thereof, such that the rate of heat transfer of the construction to be uniform on the entire built surface of said construction, for preventing the occurrence of thermal bridges.

20 Claims, 10 Drawing Sheets

(51) Int. Cl.

| | |
|---|---|
| ***E04B 2/16*** | (2006.01) |
| ***E04B 2/26*** | (2006.01) |
| ***E04C 1/40*** | (2006.01) |
| ***E04C 1/41*** | (2006.01) |
| *E04B 2/02* | (2006.01) |

(52) U.S. Cl.
CPC ..... *E04C 1/41* (2013.01); *E04B 2002/026* (2013.01); *E04B 2002/0297* (2013.01)

(58) Field of Classification Search
CPC ... E04B 1/14; E04B 1/165; E04B 2/24; E04B 2002/8676; E04B 2/26
See application file for complete search history.

(56) References Cited

U.S. PATENT DOCUMENTS 5,457,926 A * 10/1995 Jensen ..... E04B 2/18 52/309.4
5,488,806 A * 2/1996 Melnick ..... B26D 1/553 52/127.2
5,566,521 A * 10/1996 Andrews ..... E04C 1/40 52/309.17
5,839,249 A * 11/1998 Roberts ..... E04B 1/14 52/745.08
5,921,046 A * 7/1999 Hammond, Jr. ..... E04B 1/12 52/220.2
5,924,247 A * 7/1999 Van Horn ..... E04B 1/165 52/100
5,930,958 A * 8/1999 Stanley ..... E04B 2/18 52/284
5,950,397 A * 9/1999 Ginn ..... E04B 2/8629 52/436
5,992,119 A * 11/1999 Rokhlin ..... E04C 1/40 52/596
6,318,041 B1 * 11/2001 Stanley ..... E04B 1/762 52/220.2
6,412,243 B1 * 7/2002 Sutelan ..... B29C 44/12 428/182
9,856,066 B2 * 1/2018 Breaz ..... B65D 81/3825
2003/0029118 A1 * 2/2003 Grau ..... E04B 2/22 52/596
2006/0101756 A1 * 5/2006 McClure ..... E04C 1/41 52/405.1
2006/0185308 A1 * 8/2006 Lin ..... E04B 2/12 52/596
2008/0250736 A1 * 10/2008 Breaz ..... E04C 1/41 52/220.2
2008/0302040 A1 * 12/2008 Lund ..... E04B 2/26 52/309.17
2012/0285108 A1 * 11/2012 Long, Sr. ..... E04C 2/044 52/223.6
2015/0259125 A1 * 9/2015 Breaz ..... E04B 2/26 220/592.22

FOREIGN PATENT DOCUMENTS

| | | | |
|---|---|---|---|
| GB | 1 170 103 | A | 11/1969 |
| WO | 2007/081233 | A2 | 7/2007 |
| WO | 2009/061227 | A2 | 5/2009 |

* cited by examiner

PRECAST BUILDING BLOCK, MODULAR ELEMENT WITH OPTIMIZED GEOMETRY, PROCESS FOR OBTAINING THE MODULAR ELEMENT, CONSTRUCTION, METHOD FOR OBTAINING A BUILDING BY ASSEMBLING THE MODULAR ELEMENTS

TECHNICAL FIELD

The invention refers to precast blocks for constructions from which modular elements of insulating material, with optimized geometry are obtained, to a network of channels obtained by assembling the modular elements, to a supporting structure, to a process of obtaining a construction by assembling the modular elements.

BACKGROUND ART

The patent U.S. 2002017070 describes an expanded plastic module destined for building an insulated concrete wall structure by assembling the modules each another and filling them with concrete. For example, the module is made of expanded polystyrene. Each module has the form of a rigid block, having an interior configuration designed to be filled with concrete. Additionally, for increasing the strength, a network of steel or plastic bars is inserted inside the modules. The disadvantage of this technical solution consists in the high rate of concrete consumption, flow problems when casting the concrete, due to the form of the internal channels, positioned perpendicularly along the vertical and horizontal axes, the complex construction and additional manual labor brought about by the network of bars.

Modular elements for construction such as the ones described in the patent RO 123373 are known. The inconvenience of this technical solution is the difficulty in manufacturing the modular elements.

The patent GB 1170103 describes an element for construction made of an insulating material, for dome-like arched structures, having a network of interior vertical and oblique channels. The disadvantage of this technical solution is the casting of concrete each time after one row of the dome-like construction is built, implying high costs and supplementary time for labor. Moreover, it does not allow the distribution of concrete between the successive layers of construction elements.

The problem solved by this invention is the achievement of a modular element and of a construction with high energy efficiency, with a uniform rate of heat transfer on the entire surface of the construction, so that it prevents the occurrence of thermal bridges and providing a superior supporting structure, reducing the use of material and the manufacturing time.

The purpose of the invention is to obtain a light and energy-efficient construction, without casting elements, through a simple and economical process.

The technical solution consists in the obtaining and the use of optimized modular elements, made of by assembling some precast blocks, resulting a thermally insulating structure which presents on the inside a network of channels and girdle areas, in which a hardening material is cast to form the supporting structure.

DISCLOSURE OF INVENTION

The precast block for construction, according to the invention, comprises a superior area, an inferior area having an inferior face, an interior face to come in contact with another interior face of another precast block, an exterior face and two lateral faces, at least one of the lateral faces having assembling elements for joining with other precast blocks.

The interior face comprises at least one main open vertical channel that opens at least on the inferior face and at least a secondary channel starting from the lateral face and extending to the intersection with the main vertical channel.

The exterior face is provided with recessed areas and protrusions following the profile of channels from the interior face, obtaining a uniform thickness of the precast block wall, and fastening areas for veneering elements, consisting of ribs set on protrusions, and/or a surface without recesses and protrusions, obtaining a higher thickness of the precast block wall, for the precast blocks destined to be positioned in the areas where the outer surface of a construction obtained from precast blocks is larger than its inner surface thereof, such that the rate of heat transfer of the construction to be uniform on the entire built surface of said construction for preventing the occurrence of thermal bridges.

The manufacturing process of the modular elements comprises the following steps:

1. the precast blocks are cast into horizontal molds, in order to obtain a uniform density;
2. two or more of the aforesaid blocks are assembled, centered using some fitting elements placed on their interior faces thereof, in order to obtain the main and secondary interior channels;
3. the blocks previously assembled in the previous step are joined together with the aid of known fitting means.

By applying the invention, the following advantages are obtained:

- the achievement of modular elements of precast blocks, whose duration of polymerization inside the mold decreases from 2 hours to 20 minutes;
- reduced consumption of insulating material by optimization of the outer surface geometry for providing a uniform heat transfer;
- reduced consumption of the hardening material by resizing the supporting structure, simultaneously with the increase of the resistance to compression and to shearing;
- the reduced amount of material leads to lower the costs.

The special technical feature pertaining both to the precast block and to the modular element is the optimized wall structure with constant thickness on certain areas, which assures a uniform rate of heat transfer throughout the block, throughout the modular element and throughout the construction, preventing the occurrence of thermal bridges.

Also, the lower consumption of material and the reduced manufacturing time, having as result the decrease of the manufacturing costs for the precast block, leads to a decrease in manufacturing costs for the modular element and for the entire construction obtained thereof.

BRIEF DESCRIPTION OF DRAWINGS

The invention in presented subsequently in detail, with reference to FIGS. 1-25, which represent.

Figure 1:
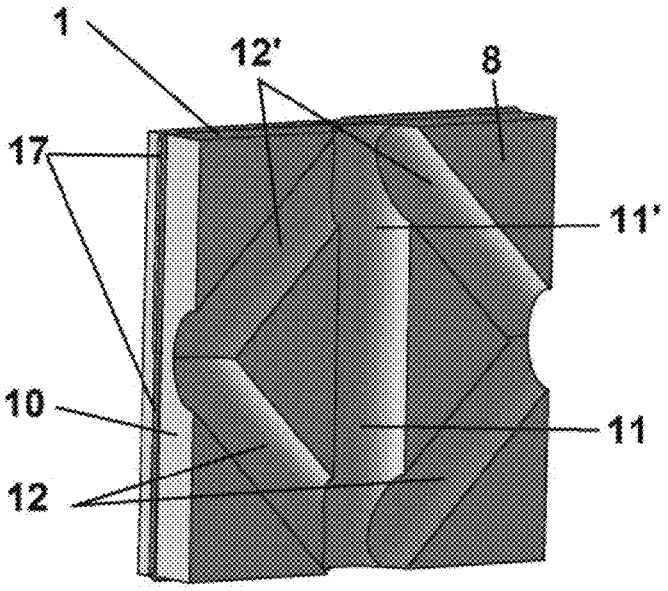
FIG. 1 Simple precast block
FIG. 2 Simple modular element
FIG. 3 Precast block for the wall
FIG. 4 Modular element for the wall
FIG. 5 Precast corner block
FIG. 6 Modular corner element
FIG. 7 Modular corner element
FIG. 8 'T-shaped' modular element FIG. 9 'T-shaped' modular element
FIG. 10 'T-shaped' modular element
FIG. 11 'T-shaped' modular element
FIG. 12 Precast block for dimensional correction
FIG. 13 Modular element for dimensional correction
FIG. 14 Simple precast block for the girdle
FIG. 15 Simple modular element for the girdle
FIG. 16 Precast corner block for the girdle
FIG. 17 Modular corner element for the girdle
FIG. 18 'T-shaped' modular element for the girdle
FIG. 19 'T-shaped' modular element for the girdle
FIG. 20 Construction—inner view
FIG. 21 Construction—outer view
FIG. 22 Thickness of precast block
FIG. 23 Thickness of modular element
FIG. 24 Heat transfer test—Thermal 1
FIG. 25 Heat transfer test—Thermal 4

The precast block 1, 2, 3, 4, 5, 6 for construction, according to the invention, comprises a superior area a, an inferior area b which comprises an inferior face, an interior face 8 to come into contact with another interior face 8 of another precast block, an exterior face 7 and two lateral faces 9 and 10.

The precast block 1, 2, 3, 4, 5, 6 for construction, according to the invention, comprises:

an inferior area b which comprises at least one open vertical channel 11 and at least one secondary open oblique channel 12 starting from the lateral face 10 and intersecting the main vertical channel 11 on the inferior face;

a superior area a comprising at least one open vertical channel 11' being in prolongation of the open vertical channel 11 from inferior half b and at least one secondary open oblique channel 12', starting from lateral face 10 and intersecting the main vertical channel 11' on the level of a superior face.

On the interior face 8, fitting elements 13 are provided, for fastening to interior face 8 of another precast block.

On the exterior face 7, there are provided:

recessed areas 27 and protrusions 14 following the profile of the channels 11, 12 from the interior face 8, achieving a uniform thickness g of the precast block wall, as well as fastening areas for veneering elements, made of ribs 15 placed on the protrusions 14, and/or surface without recesses 27 and protrusions 14, achieving a higher thickness of the precast block wall, for the precast blocks destined to be positioned in areas where the outer surface of a construction 31, obtained from the precast blocks 1, 2, 3, 4, 5, 6 is larger than the inner surface thereof, such that the heat transfer rate in the construction 31 is uniform on the entire built surface of the construction 31, to prevent the occurrence of thermal bridges.

The exterior face 7 also contains an external channel 16 for inserting of a fireproof plate. At least the lateral faces 10 contain groove and tongue type assembling elements 17, to be joined with other precast blocks.

Modular element 19, 20, 21, 22, 23, according to the invention, is obtained by joining together the interior faces 8 of at least two precast blocks 1, 2, 3, 4, forming on the inside closed main vertical channels 28 and closed secondary channels 29, destined for casting a hardening material.

The manufacturing process of the modular element 19, 20, 21, 22, 23, according to the invention, comprises the following steps:

the precast blocks 1, 2, 3, 4, 5, 6 are cast into horizontal molds, such that a uniform density is obtained. The horizontal mold offers the advantage of better controlling the density of the insulating material, obtaining a greatly increased uniformity of the vertical density compared to the casting methods in a vertical mold. The reduced thickness of the precast blocks, leads to the decrease of the time required for polymerization inside the mold, from 2 hours to 20 minutes;

two or more precast blocks are assembled, centered using the fitting elements 13 placed on the interior faces 8 thereof, to obtain the main closed channels 28 and secondary closed channels 29;

the precast blocks 1, 2, 3, 4, 5, 6, assembled during the previous step, are fixed with the aid of known fixation means, such as gluing with adhesives, but not limited thereof.

MODES FOR CARRYING OUT THE INVENTION

For a better understanding of the invention, the following embodiments are disclosed, in connection with the figures:

EXAMPLE 1

The precast block 1 from FIG. 1 has on its inferior area b one open vertical channel 11 and a first and a second secondary open oblique channel 12, both starting from the lateral faces 10 and intersecting the main vertical channel 11 in the median area of the inferior face, and on the superior area a, one open vertical channel 11' being in prolongation of the open vertical channel 11 from the inferior area b, and a third and a fourth secondary open oblique channel 12' both starting from the lateral faces 10 and intersecting the main vertical channel 11' in the median area of a superior face.

Figure 2:
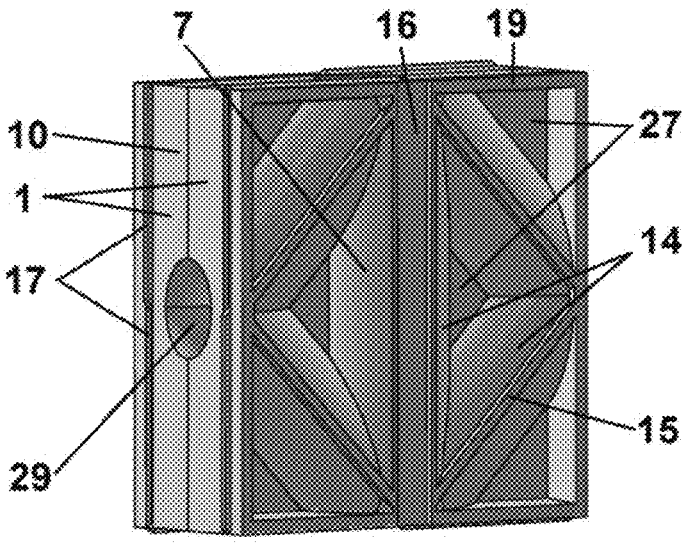

On the exterior face 7, recessed areas 27 and protrusions 14 are provided, following the profile of channels 11, 11', 12, 12' from the interior face 8, achieving a uniform thickness of the precast block wall, and fastening areas for veneering elements, consisting of ribs 15 placed on the protrusions 14, and one external channel 16 for the insertion of a fireproof plate. The modular element 19 from FIG. 2 comprises two precast blocks 1 joined on the interior faces 8, forming on the inside one main vertical channel 28 and four secondary closed channels 29, destined for casting a hardening material.

EXAMPLE 2

Figure 3:
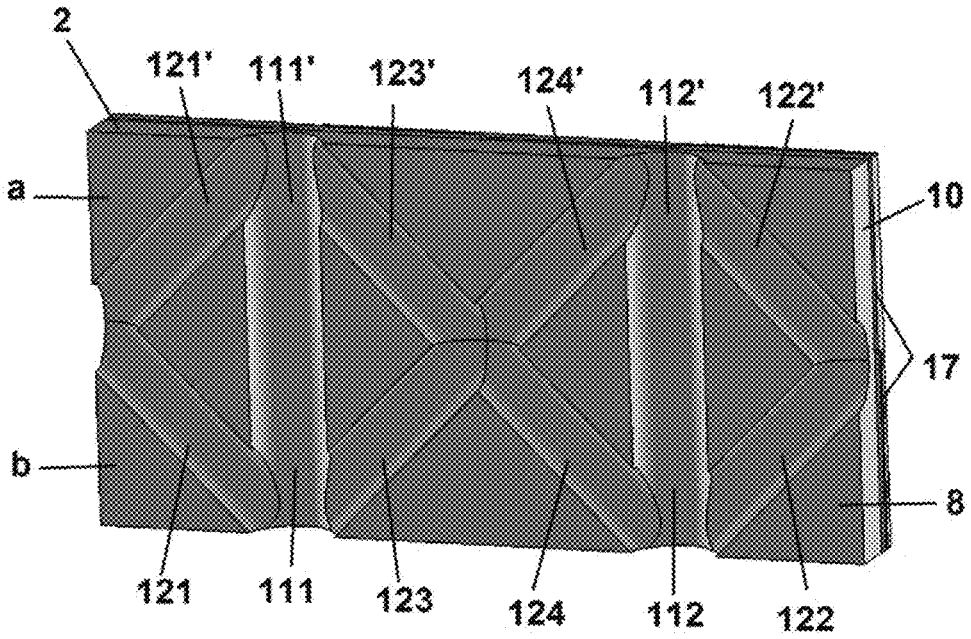

The precast block 2 for the wall from FIG. 3 is provided on the inferior area b with two open vertical channels 11, from which a first open vertical channel 111 and a second open vertical channel 112 and four secondary open oblique channels 12, from which a first secondary open oblique channel 121 and a second secondary open oblique channel 122, both starting from lateral faces 10 and intersecting the main vertical channels 111, 112 on the inferior face of the precast block, and a third secondary open oblique channels 123 and a fourth secondary open oblique channel 124, both starting from the intersection area of the main open vertical channels 111, 112 with the first secondary channel 121 and the second secondary channel 122, extending to the median area of the precast block, where they intersect, and on the superior area a with a third open vertical channel 111' in prolongation of the first open vertical channel 111 from inferior area b, and a fourth open vertical channel 112' extending the second open vertical channel 112 from inferior area b, and four secondary open oblique channels 12', from which a fifth secondary open oblique channel 121' and a sixth secondary open oblique channel 122' start from lateral faces 10 and intersect the third main vertical channel 111' and the fourth main vertical channel 112' at a superior face of the precast block 2 and a seventh secondary open oblique channel 123' and an eighth secondary open oblique channel 124' starting from the intersection zone of the third main open vertical channel 111' with a fifth secondary open oblique channel 121', respectively from the intersection area of the fourth main open vertical channel 112' with a sixth secondary open oblique channel 122' and continues to the median area of the precast block, where it intersects the third secondary open oblique channel 123 and the fourth secondary open oblique channel 124 that are located in the extension thereof.

On the exterior face 7, the recessed areas 27 and the protrusions 14 are provided, following the profile of the channels 111, 111', 112, 112', 121, 121', 122, 122', 123, 123', 124, 124' from the interior face 8, obtaining a uniform thickness of the precast block wall, and fastening areas for veneering elements, consisting of ribs 15 placed on the protrusions 14. The exterior face 7 also contains two external channels 16 for the insertion of fireproof plates.

Figure 4:
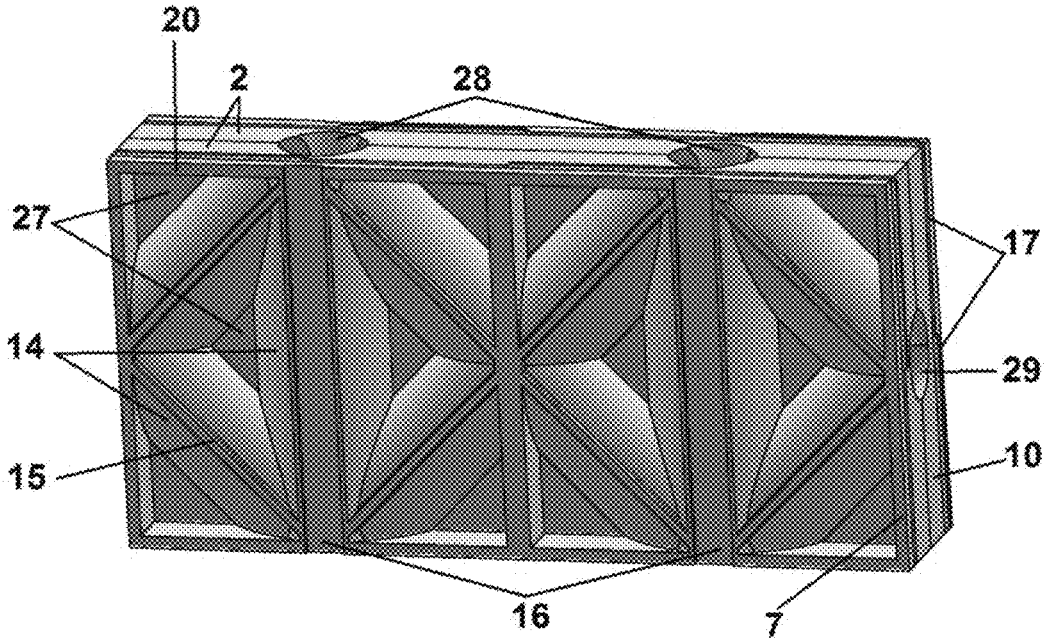
Figure 5:
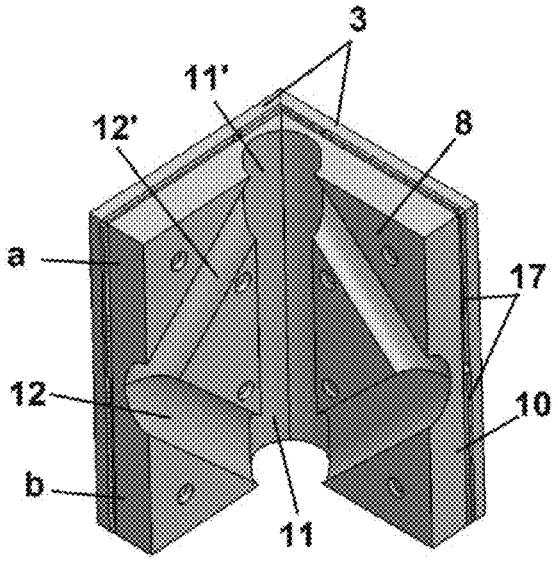
Figure 6:
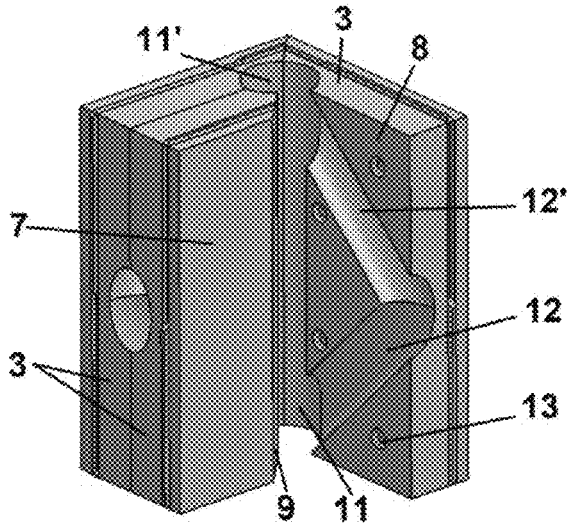

The modular element 20, from FIG. 4, is made up of two precast blocks 2 joined on their interior faces 8, forming on the inside, two main vertical channels 28 and six secondary closed channels 29, destined for casting a hardening material.

EXAMPLE 3

The precast block 3 for the corner, from FIGS. 5, 6, 8 and 10 is provided with an interior lateral face 9 and an exterior lateral face 10 that forms with the interior face 8 and with the exterior face 7 an angle enabling the assemblage with other precast corner blocks 3.

On its inferior area b, the precast block 3 has one main open vertical channel 11 uniting the interior face with the interior lateral face 9 and one secondary open oblique channel 12 starting from the exterior lateral face 10 and intersecting with the main vertical channel 11 on the lower side of the interior lateral face 9, and on the superior area a, it is provided with one main open vertical channel 11' in the prolongation of the main open vertical channel 11 from the inferior area b and one secondary open oblique channel 12' starting from exterior lateral face 10 from the intersection area with the secondary oblique channel 12 located on the inferior area b and intersects the main vertical channel 11' from superior area a.

On the internal face 8, fitting elements 13 are provided for joining with another internal face 8 of another precast block.

The exterior face 7 is provided with a surface without the recesses 27 and the protrusions 14, obtaining a higher thickness of the wall of the precast block 3.

Figure 7:
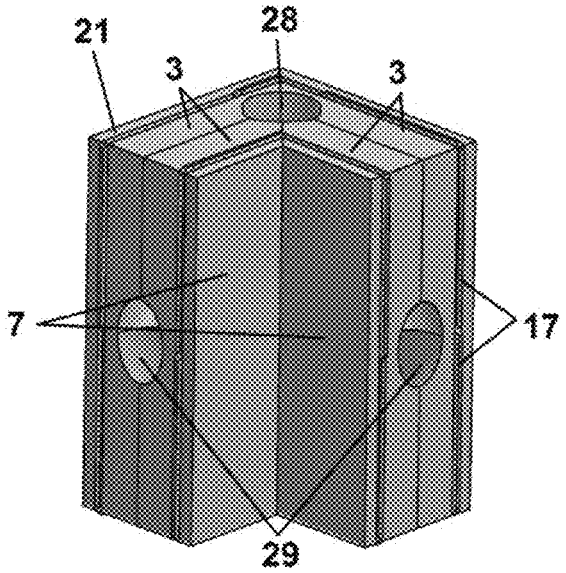
Figure 8:
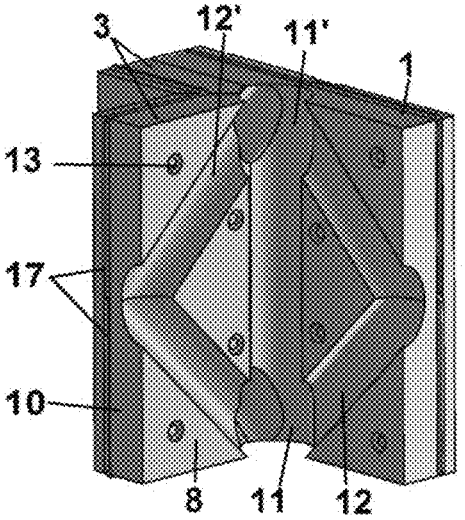

The modular element 21 for the corner from FIG. 7 is formed by assembling four precast corner blocks 3, joined on the interior lateral face 9 and on the interior faces 8, such that it forms on the inside one main closed vertical channel 28 and four secondary closed oblique channels 29, for casting a hardening material.

EXAMPLE 4

Figure 9:
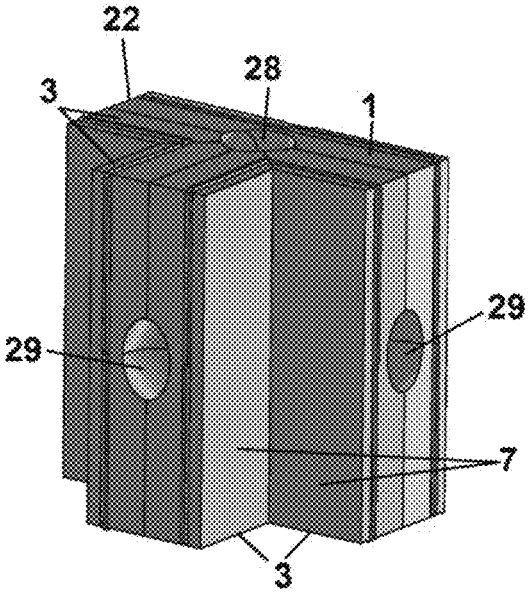
Figure 10:
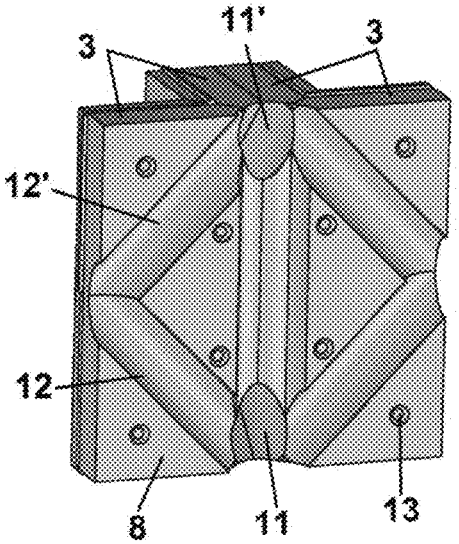
Figure 11:
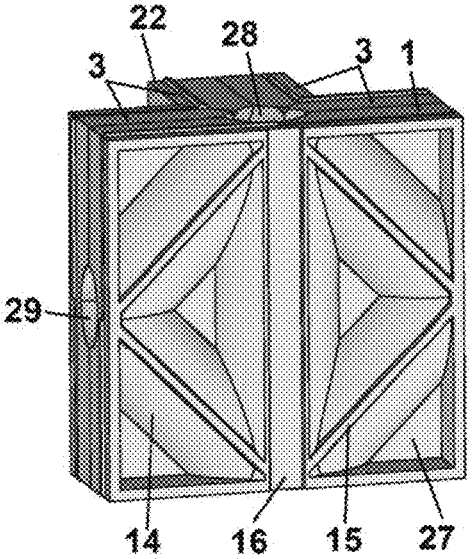

The 'T-shaped' modular element 22 from FIGS. 9 and 11 is made by combining four precast corner blocks 3 joined on the interior lateral face 9 and the interior faces 8, assembled with one precast block 1, such that it forms on the inside one main closed vertical channel 28 and six secondary closed oblique channels 29, for casting a hardening material.

EXAMPLE 5

Figure 12:
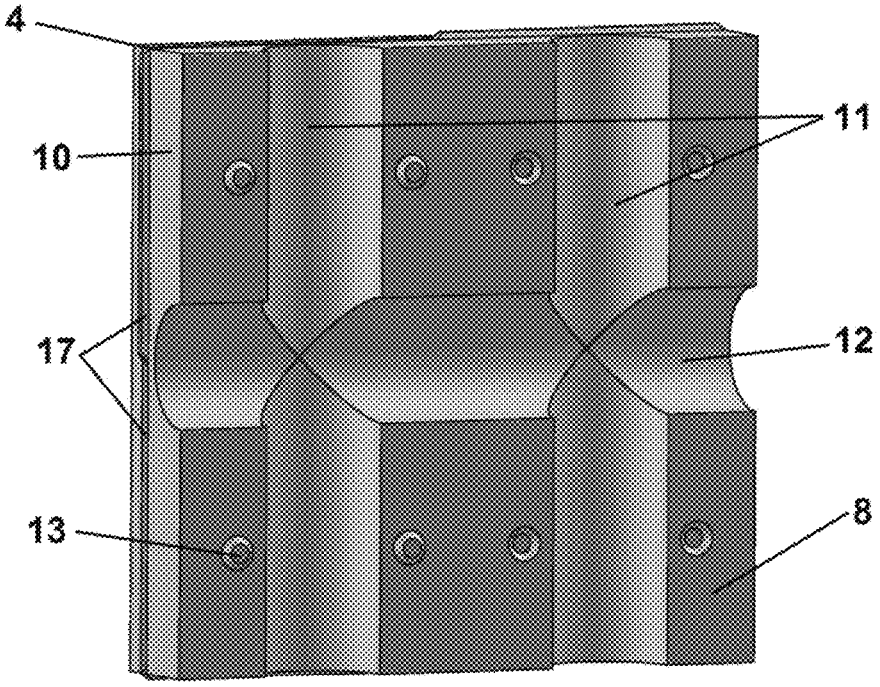

The precast block 4 for dimensional correction from FIG. 12, has on the interior face 8 two main open vertical channels 11 that unite the inferior face with the superior face of the precast block 4 and one secondary open horizontal channel 12 that unites the median areas of the lateral faces 10 and intersects the main vertical channels 11 in median area thereof.

Figure 13:
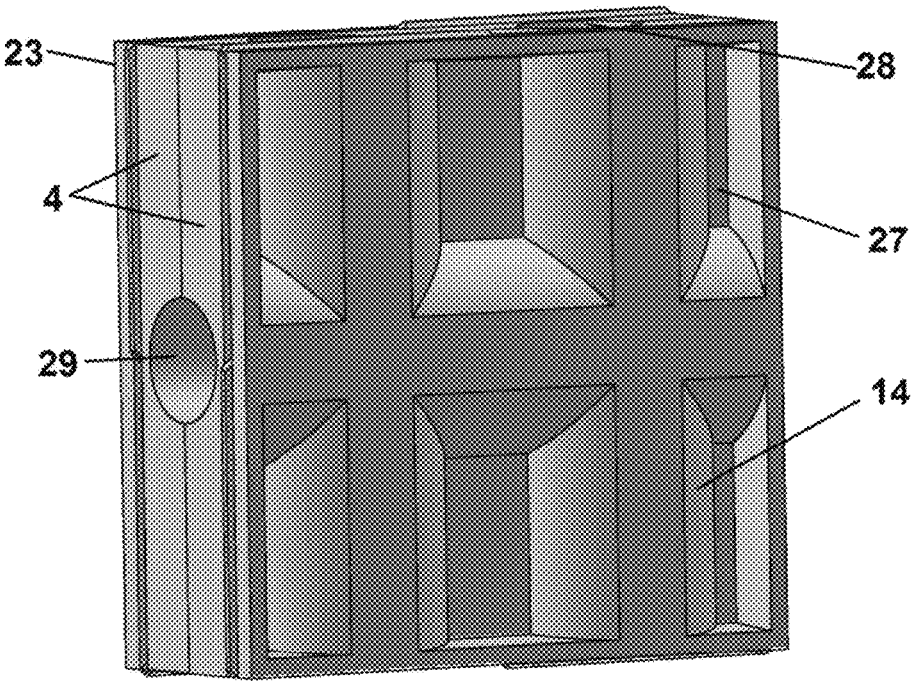

The modular element 23 for dimensional correction from FIG. 13 is made of two precast blocks 4 joined on their interior faces 8, forming on the inside two main vertical closed channels 28 and one secondary closed channel 29, for casting a hardening material.

EXAMPLE 6

Figure 14:
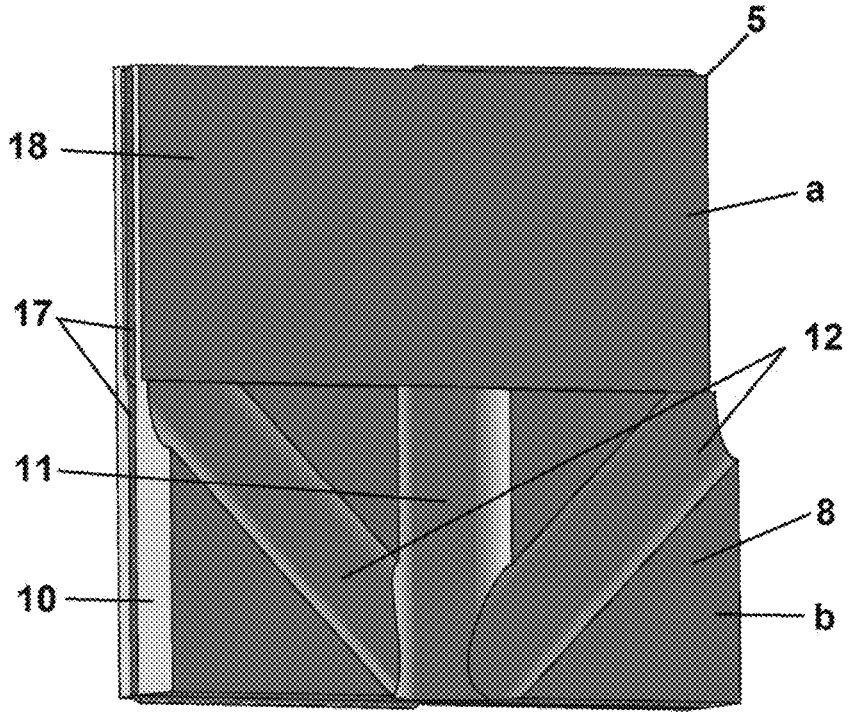

The precast block 5 for the girdle from FIG. 14 is provided on the superior area a with a vertical wall 18 which prolongs the exterior face 7 from the inferior area b, having constant thickness, substantially equal with the thickness of the precast block from inferior area b, in order to provide a uniform heat transfer.

Figure 15:
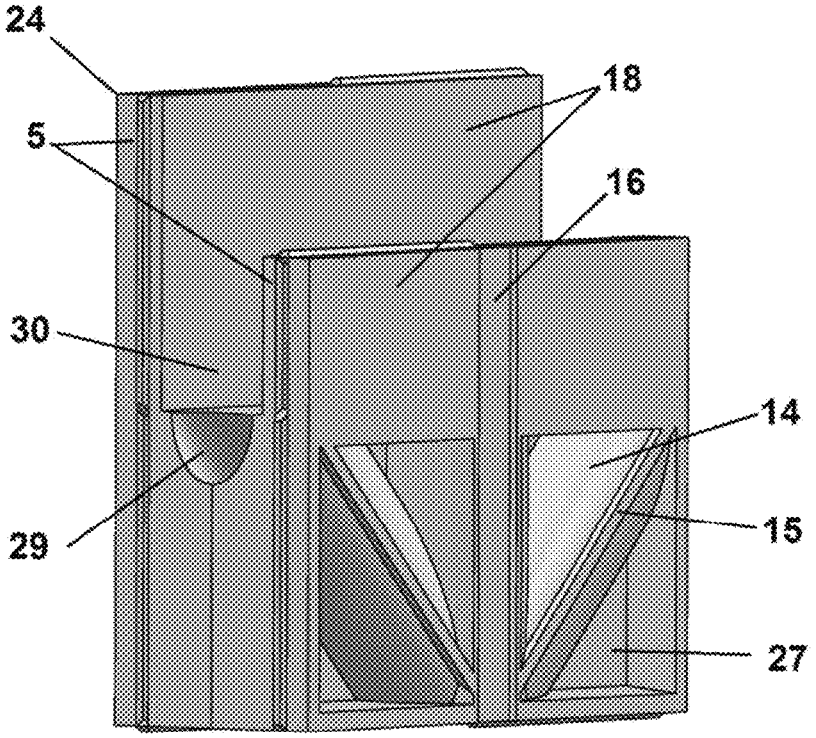

The modular element 24 for the girdle from FIG. 15 is formed by assembling two precast blocks 5, having on the superior half an open 'U-shaped' channel 30 made of the vertical walls for the girdle 18 and of the superior part of inferior area b, forming on the inside of inferior area b, one main closed vertical channel 28 and two secondary closed oblique channels 29, intersecting one another and communicating with open 'U-shaped' channel 30, channels 28, 29 and 30 being destined for casting a hardening material.

EXAMPLE 7

Figure 16:
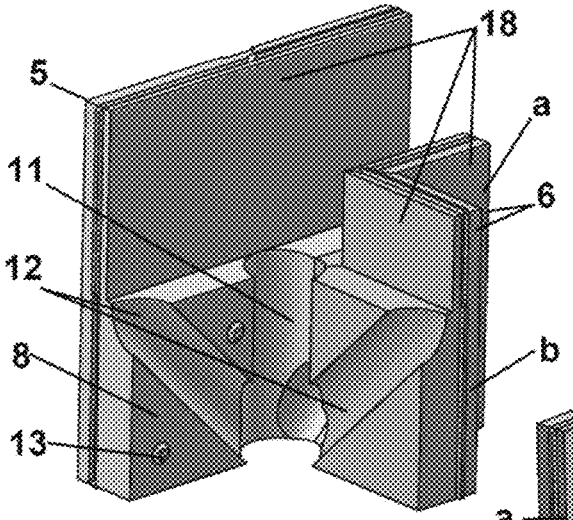
Figure 17:
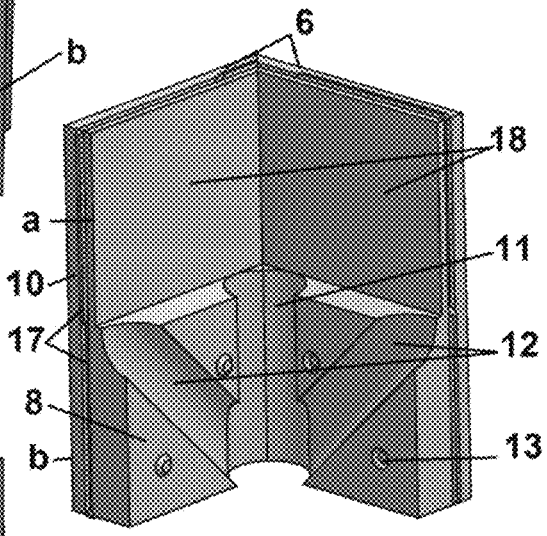

The precast corner block 6 for the girdle from FIGS. 16 and 17 is provided in the superior area a with one vertical wall 18 prolonging the exterior face 9 from the inferior area b, having a constant thickness, substantially equal with the thickness of the precast block from the inferior area b, to keep the heat transfer uniform.

Figure 19:
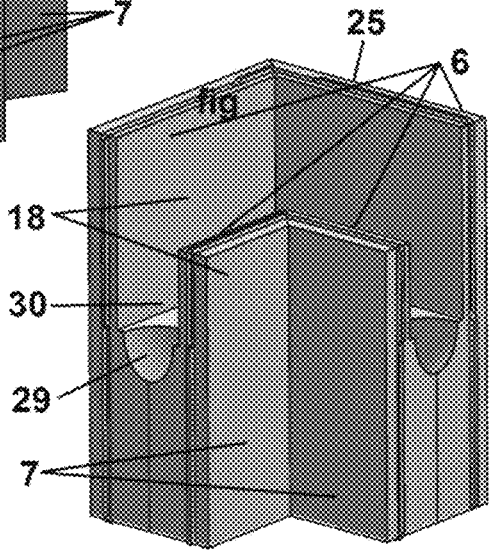

The corner modular element for the girdle 25 from FIG. 19 is formed by joining four precast blocks 6, having at the superior area two perpendicular open 'U-shaped' channels 30, formed by the vertical girdle walls 18 and the superior part of inferior area b, forming on the inside of the inferior area b one main closed vertical channel 28 and two secondary closed oblique channels 29, intersecting one another, communicating with the open 'U-shaped' channels 30, the channels 28, 29, 30 being destined for casting a hardening material.

EXAMPLE 8

Figure 18:
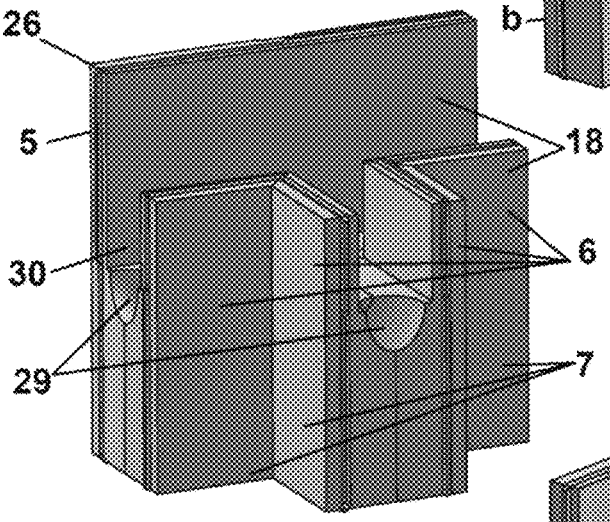

The 'T-shaped' modular element 26 for the girdle from FIG. 18 is provided by combining four precast blocks 6 joined on the interior lateral face 9 and on the interior faces 8, assembled by one precast block 5, having on its upper half two perpendicular open 'U-shaped' channels 30, formed by the vertical girdle walls 18 and by the upper part of inferior area b, forming on the inside of the inferior area b one main closed vertical channel 28 and three secondary closed oblique channels 29, intersecting one another, communicating with the open 'U-shaped' channels 30, the channels 28, 29, 30 being destined for casting a hardening material.

EXAMPLE 9

Figure 20:
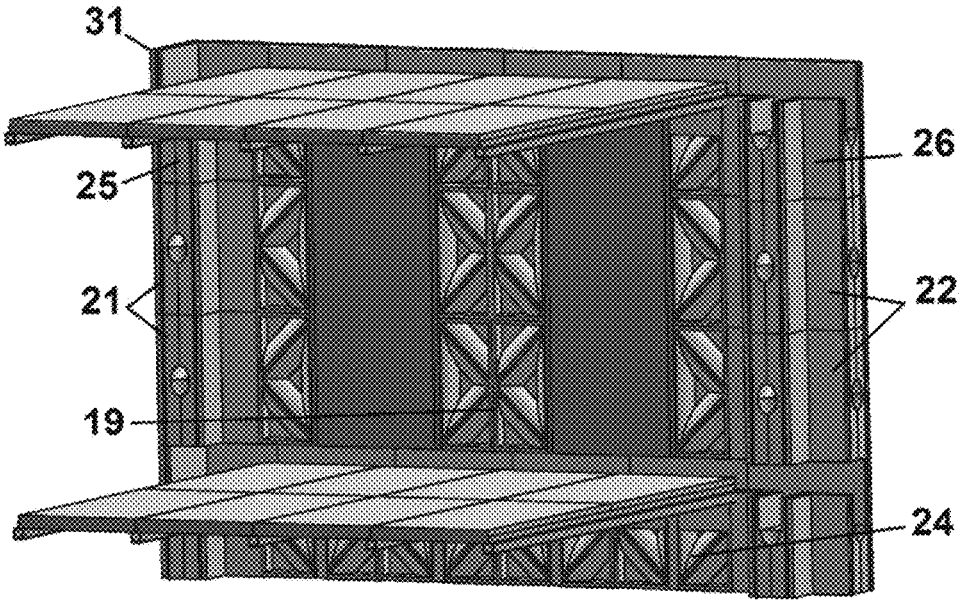
Figure 21:
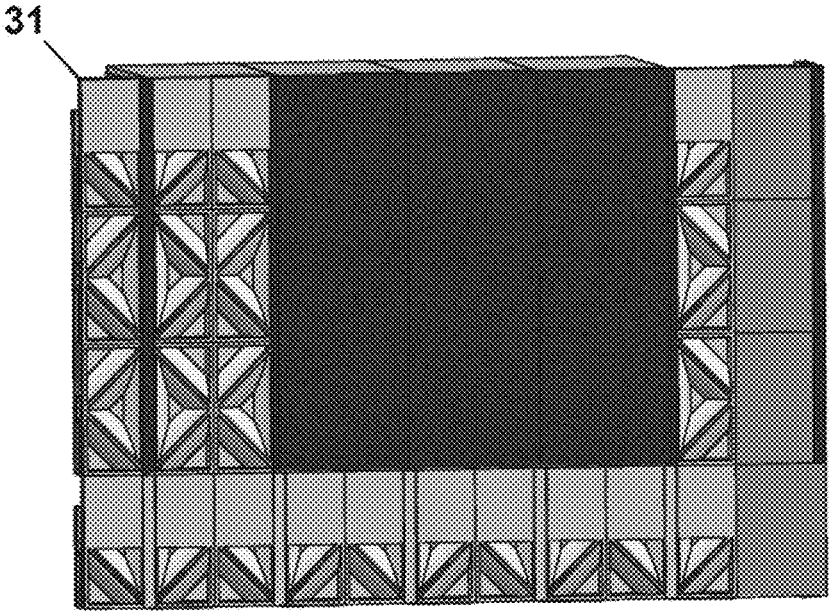

The construction 31 from FIGS. 20-21, according to the invention, is made of by assembling a plurality of modular elements, such that to obtain an insulating structure, having on inside a network of main closed channels 28, secondary closed oblique channels 29, and 'U-shaped' channels 30, which communicate one to another, thus forming a supporting structure inside of the insulating structure, the supporting structure being obtained by casting a material that hardens in the network of channels 28, 29, 30.

The precast blocks 1, 2, 3, 4, 5, 6, according to the invention, are made from synthetic foams based on polyurethanes, polyimides, polyethylene, polypropylene, polyvinyl chloride, polyvinylidene chloride, amino resins, phenolic resins, silicones, expanded polystyrene, and sodium silicate.

The material to be cast in the network according to the invention, in order to harden and to form the supporting structure of the construction 31 is selected from the following: concrete, reinforced concrete, polyester resins, epoxy resins, polyurethane resins.

In relation to the examples above, the following preferred dimensions are given, the precast blocks according to the invention not being limited to them:

The precast block 1 is 1 m long, 1 m high and 19 cm thick.

The precast 2 is 2 m long, 1 m high and 19 cm thick.

The precast 3 is 31 to 69 cm long, 1 m high and 19 cm thick.

The precast 4 is 1 m long, 1 m high, 19 cm thick.

The diameter of the main vertical channel 28 is 20 cm, and the diameter of secondary oblique channels 29 is 16 cm.

Figure 22:
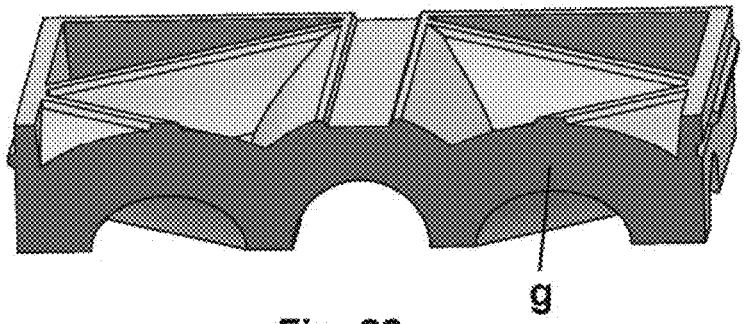

FIG. 22 represents a section across the precast block 1, with thickness g of the insulating material being constant throughout the section, having as effect that the flow of thermal energy passing from the inside to outside to be constant at any point of the precast block.

Figure 23:
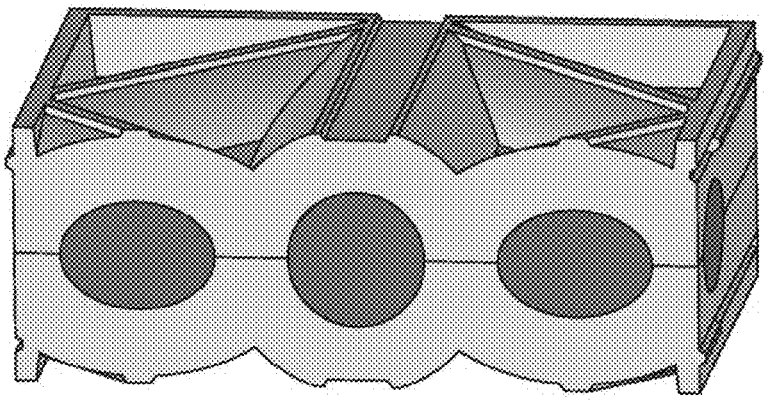

On the section of the modular element 19, from FIG. 23, it can be noticed that the thickness of the insulating material, destined to surround the hardening material, is uniform. Consequently, the heat transfer between the two faces of the modular element, respectively from the internal face of a construction obtained from modular elements to the external face thereof, is uniform on the entire surface.

Studies and tests to select the optimal geometry of the precast block, and of the modular element respectively, have been conducted, so that a constant heat transfer could be obtained, without the occurrence of thermal bridges.

Figure 24:
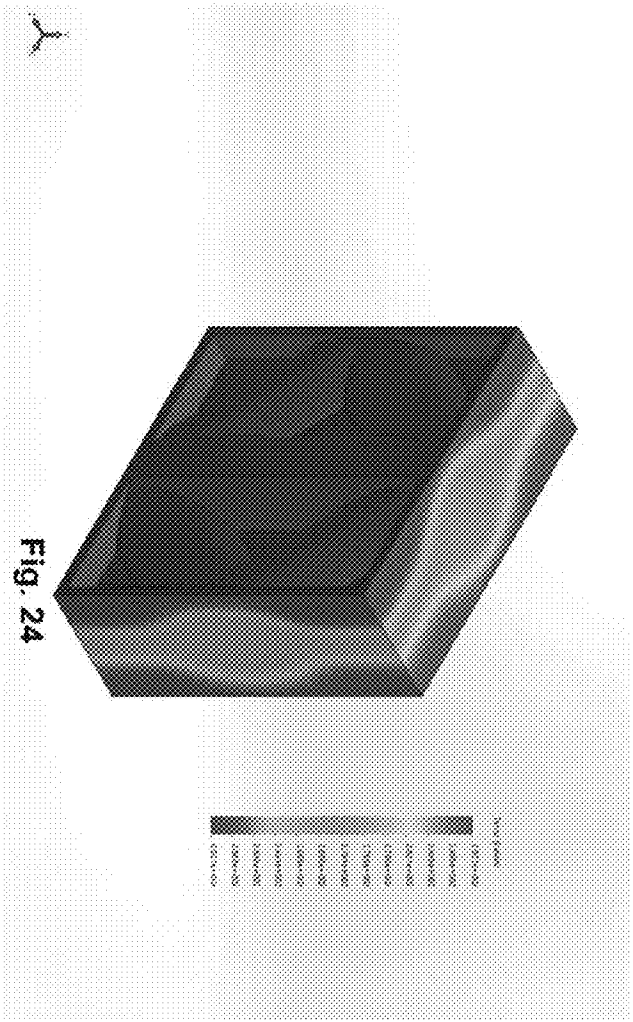

Thus, FIG. 24 shows the distribution of the temperatures on the outside −20° C. (in blue) and +20° on the interior face (in red). Between the two faces of the modular element, a uniform heat transfer takes place, through both the insulating material and the hardening material (concrete).

Figure 25:
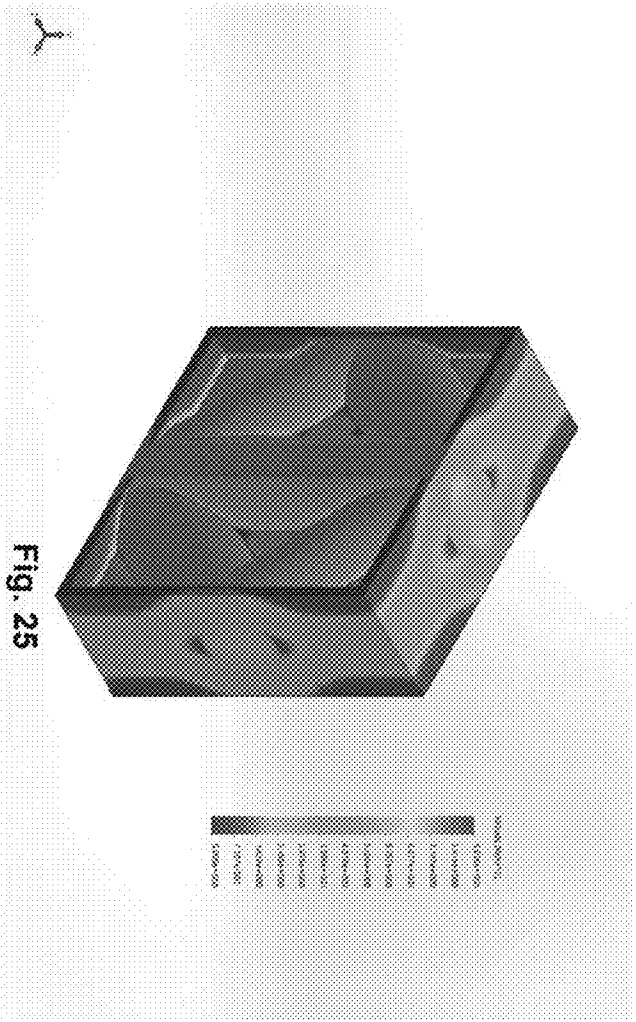

FIG. 25 shows the flows of energy (heat), passing through the modular element, the blue areas standing for a lack of heat transfer (0 $W/m^2$), whereas read areas represent a maximum energy transfer. The green area shows the average heat transfer, of 4.3 $W/m^2$. On FIG. 25, it can be noticed that the flow of heat through the areas covering the concrete is uniform, being of the color green, which means a flow of 4.3 $W/m^2$ has been achieved, resulting that no thermal bridge occurs, therefore no condensation risks exist.

Example of Achievement of a Construction 31

The foundation is laid down on ground level or below ground level by casting a concrete plate 32, on top of which a row of modular elements for the girdle 24, 25, 26 are fixed, with the aid of known fixation means;

insulating elements are placed over the concrete plate, then it is reinforced and the hardening material is cast, thus resulting the supporting structure for the first row of modular elements for the girdle 24, 25, 26 and the floor of the first level;

two rows of modular elements 19, 20, 21, 22 are placed, on top of which a row of elements for the girdle 24, 25, 26 are set in order to create the first level. If there are uncovered spaces, they are completed with modular elements 23 for dimensional correction until the desired dimensions are obtained, resulting the walls of the first level of the construction 31. The network of the first level is reinforced and hardening material is cast in it, leading, by hardening, to the supporting structure;

fireproof plates are set up in channels 16, being preferably of magnesium oxide, and veneering elements, preferably of magnesium oxide, are set up on the outside and on the inside of the walls. The purpose of the fireproof plates from channels 16 is to prevent a fire from spreading at the junction of the two magnesium oxide plates;

the ceiling is cast or set up;

the procedures from the previous steps are repeated for each superior level.

It is preferable, in this embodiment, that the material for manufacturing the precast blocks is low-density polyurethane foam, of 40-50 $kg/m^3$.

Preferably, the modular elements are obtained my gluing together precast blocks with polyurethane adhesive. Preferably, the hardening material to be cast in the network of channels to form the supporting structure, is C16/20 concrete.

After the concrete hardens, the resistance to compression of the load-bearing wall is over 150 tones/linear meter of load-bearing masonry, and the resistance to shearing is over 50 tones.

The invention claimed is:

1. A precast block for construction, comprising:

an upper area;

a lower area comprising a lower interior face;

an interior face configured to come in contact with another interior face of a second precast block, the interior face comprising the lower interior face;

an exterior face; and two lateral faces, wherein the interior face comprises:

at least one main open vertical channel that opens at the lower interior face, and at least one secondary open channel that starts from one of the two lateral faces and extends to an intersection with the at least one main vertical channel, wherein at least one of the two lateral faces comprises assembling elements for joining with a third precast block, and wherein the exterior face comprises:

one or more recessed areas; and a plurality of protrusions from the one or more recessed areas, each of the plurality of protrusions following a profile of the at least one main open vertical channel and the at least one secondary open channel on the interior face, respectively, to provide a uniform thickness of a precast block wall, and the plurality of protrusions comprising fastening areas for veneering elements formed by ribs set on the protrusions.

2. The precast block according to claim 1, wherein the lower area comprises:

the at least one main open vertical channel, and the at least one secondary channel including a first and a second secondary open oblique channel starting from respective ones of the two lateral faces and intersecting with the at least one main open vertical channel in a median zone of the lower interior face of the lower area, wherein the upper area comprises:

an extended portion of the at least one main open vertical channel placed in prolongation from the lower area, and a third and a fourth secondary open oblique channel starting from respective ones of the two lateral faces and intersecting with the extended portion of the at least one main open vertical channel in a median zone of an upper interior face of the upper area, wherein one or more fitting elements are provided on the interior face for coupling with one or more corresponding fitting elements on the another interior face of the second precast block, and wherein each of the plurality of protrusions follow a profile of the at least one main open vertical channel and the at least one secondary open channel on the interior face, respectively, to provide the uniform thickness of the precast block wall, the plurality of protrusions comprising fastening areas for veneering elements formed by ribs set on the protrusions.

3. The precast block according to claim 1, wherein the lower area comprises:

the at least one main open vertical channel including a first main open vertical channel and a second main open vertical channel, and the at least one secondary open channel including:

a first secondary open oblique channel and a second secondary open oblique channel starting from the respective ones of the two lateral faces and intersecting with the first main open vertical channel and the second main open vertical channel, respectively, and a third secondary open oblique channel and a fourth secondary open oblique channel starting from respective intersections of the first and second main open vertical channels with the first and second secondary open oblique channels and extending to, and intersecting at, a central median zone of the interior face, wherein the upper area comprises:

a third main open vertical channel prolonging the first main open vertical channel from the lower area, a fourth main open vertical channel prolonging the second main open vertical channel from the lower area, and a fifth secondary open oblique channel and a sixth secondary open oblique channel starting from respective ones of the two lateral faces and intersecting with the third main open vertical channel and the fourth main open vertical channel, respectively, a seventh secondary open oblique channel and an eighth secondary open oblique channel starting from respective intersections of the third and fourth main open vertical channels with the fifth and sixth secondary open oblique channels and extending to, and intersecting at, the central median zone of the interior face, where the seventh and eighth secondary open oblique channels intersect with the third and fourth secondary open oblique channels, wherein one or more fitting elements are provided on the interior face for coupling with one or more corresponding fitting elements on the another interior face of the second precast block, and wherein each of the plurality of protrusions follow a profile of the at least one main open vertical channel and the at least one secondary open channel on the interior face, respectively, to provide the uniform thickness of the precast block wall, the plurality of protrusions comprising fastening areas for veneering elements formed by ribs set on the protrusions.

4. The precast block according to claim 1, wherein the two lateral faces comprise an interior lateral face and an exterior lateral face that form, with the interior face and with the exterior face, an angle allowing assembly with a plurality of other precast blocks to form a corner, wherein the lower area comprises:

one main open vertical channel which unites the interior face with the interior lateral face and one secondary open oblique channel starting from the exterior lateral face, intersecting the one main open vertical channel at a lower zone of the interior lateral face, and wherein the upper area comprises:

one main open vertical channel prolonging the one main open vertical channel from the lower area and another one secondary open oblique channel starting from the exterior lateral face from an intersection with the one secondary oblique channel from the lower area and intersects the one main open vertical channel from the upper area, and wherein the fitting elements are provided on the interior face for assembling with the another interior face of the second precast block, and wherein the exterior face is provided with a surface without the one or more recessed areas and the plurality of protrusions, thus forming a higher thickness of the precast block wall, for positioning the precast block at, a location where an outer surface of a construction is larger than an inner surface thereof.

5. The precast block according to claim 1, wherein on the interior face, the at least one main open vertical channel includes two main open vertical channels that unite the lower interior face with an upper interior face of the precast block for dimensional correction, and the at least one secondary open channel unites median zones of the two lateral faces and intersects the two main open vertical channels at respective median zones thereof, wherein one or more fitting elements are provided on the interior face for coupling with one or more corresponding fitting elements on the another interior face of the second precast block, wherein the assembling elements are of a groove and tongue type, and wherein each of the plurality of protrusions follow a profile of the at least one main open vertical channel and the at least one secondary open channel on the interior face, respectively, to provide the uniform thickness of the precast block wall, the plurality of protrusions comprising fastening areas for veneering elements formed by ribs set on the protrusions.

6. The precast block according to claim 1, wherein the upper area comprises a vertical wall having a constant thickness, substantially equal to the uniform thickness of the precast block for providing a uniform heat transfer.

7. A modular element, formed by joining the interior fixes of two precast blocks according to claim 2, wherein the modular element comprises a plurality of main closed vertical channels and a plurality of secondary closed channels, destined for casting a hardening material.

8. A modular element for a corner formed by combining four precast blocks according to claim 4, which are joined at the interior lateral face and on the interior faces of each respective precast block, wherein the modular element for the corner comprises, on an inside thereof, one main closed vertical channel and four secondary closed oblique channels configured for casting a hardening material.

9. A 'T-shaped' modular element, formed by combining four precast blocks according to claim 4, which are joined at the interior lateral face and on the interior faces of each respective precast block and which are assembled with a different precast block, wherein the 'T-shaped' modular element comprises, on an inside thereof, one main closed vertical channel and six secondary closed oblique channels configured for casting a hardening material.

10. A modular element for a girdle, formed by joining at least two precast blocks according to claim 6, comprising, on the upper area, at least one open 'U-shaped' channel formed by respective vertical walls for the girdle and the upper side of the lower area of the respective precast blocks, forming, on an inside of the lower area, at least one main closed vertical channel and at least two secondary closed oblique channels, intersecting One another, communicating with the open 'U-shaped' channel and configured for casting a hardening material.

11. The precast block according to claim 1, comprising a material selected from synthetic foams based on polyurethanes, polyimide, polyethylene, polypropylene, polyvinyl chloride, polyvinylidene chloride, amino resins, phenolic resins, silicones, expanded polystyrene, and sodium silicate.

12. A construction comprising a plurality of precast blocks according to claim 1 assembled in a plurality of modular elements, wherein the plurality of modular elements are assembled to form an insulating structure with a network of main closed vertical channels and secondary closed channels and girdle areas on an inside, communicating with one another, wherein a supporting structure is formed inside the insulating structure, the supporting structure being obtained by casting a hardening material in the network of channels and girdle areas and the hardening material being selected from a group including concrete, reinforced concrete, polyester resins, epoxy resins, and polyurethane resins.

13. A process for manufacturing the modular element from the precast blocks according to claim 1, comprising:

casting two or more of the precast blocks in horizontal molds for achieving a uniform density;

assembling the two or more precast blocks centered by means of the fitting elements for obtaining the main closed vertical channels and the secondary closed channels; and fixing the assembled precast blocks.

14. A process for obtaining the construction according to claim 12, comprising:

casting a concrete plate on a ground level or below a ground level to form a foundation;

fixing a first row of the plurality of modular elements on top of the concrete plate to form a girdle;

placing insulating elements over the concrete plate;

reinforcing and casting the hardening material to obtain the supporting structure in the first row of the plurality of modular elements for the girdle and the ground level or an underground level floor;

placing two rows of the plurality of modular elements, on which a row of a different type of modular element for a girdle is placed, to form a first level;

completing spaces left uncovered by placing additional ones of the plurality of modular elements for dimensional correction and for obtaining the desired dimensions, resulting walls of the first level, reinforcing and casting the hardening material in the network of the first level, resulting by hardening, the supporting structure;

setting up fireproof plates in channels, and veneering elements on an outside and on an inside of the walls;

forming a ceiling; and repeating one or more of the preceding steps for each additional level.

15. A modular element for a wall formed by joining the interior faces of two precast blocks according to claim 3, wherein the modular element for the wall comprises on an inside thereof two main closed vertical channels and six secondary closed oblique channels destined for casting a hardening material.

16. A modular element for dimensional correction formed by joining the interior faces of two precast, blocks for dimensional correction according to claim 5, wherein the modular element for dimensional correction comprises on an inside thereof two main closed vertical channels and one secondary closed channel configured for casting a hardening material.

17. The precast block according to claim 6, wherein the two lateral faces comprise an interior lateral face and an exterior lateral face that form, with the interior face and with the exterior face, an angle allowing assembly with a plurality of other precast blocks to form a corner, wherein the exterior face is provided with a surface without the one or more recessed areas and the plurality of protrusions, thus forming a higher thickness of the precast block wall, for positioning the precast block at a location where an outer surface of a construction is larger than an inner surface thereof.

18. The modular element for a girdle according to claim 10, wherein the modular element is without the one or more recessed areas and the plurality of protrusions for positioning the modular element at a location where an outer surface of a construction is larger than an inner surface thereof.

19. The construction according to claim 12, wherein at least a subset of the modular elements each comprise a surface without the one or more recessed areas and the plurality of protrusions, thus forming a higher thickness of the precast block wall, and are positioned at locations where an outer surface of the construction is larger than an inner surface thereof.

20. The process according to claim 14, wherein at least a subset of the modular elements each comprise a surface without the one or more recessed areas and the plurality of protrusions, thus forming a higher thickness of the precast block wall, and are positioned at locations where an outer surface of the construction is larger than an inner surface thereof.

* * * * *